United States Patent [19]

Hayden

[11] Patent Number: 4,911,186

[45] Date of Patent: Mar. 27, 1990

[54] CONVERTIBLE HAIR ROLLER

[75] Inventor: Fred R. Hayden, San Jose, Calif.

[73] Assignee: The Schawbel Corporation, Cambridge, Mass.

[21] Appl. No.: 132,064

[22] Filed: Dec. 11, 1987

[51] Int. Cl.[4] ..... A45D 2/18

[52] U.S. Cl. ..... 132/246

[58] Field of Search ..... 132/250, 252, 246, 247, 132/261

[56] References Cited

U.S. PATENT DOCUMENTS

| | | | |
|---|---|---|---|
| 2,166,386 | 7/1939 | Auster | 132/246 |
| 2,720,207 | 10/1955 | Burtnett | 132/246 |
| 3,590,829 | 7/1971 | Parisi | 132/247 |

*Primary Examiner*—Kenneth J. Dorner
*Assistant Examiner*—J. Hakomaki
*Attorney, Agent, or Firm*—Peter L. Berger; Andrew S. Langsam

[57] ABSTRACT

A convertible hair roller includes first and second flexible outer sheets connected together in parallel spaced relation, two parallel memory wires positioned between the sheets and capable of repeated deformation between a straight configuration and a circular configuration, with each memory wire automatically deforming from the straight configuration to the circular configuration upon application of heat of a predetermined temperature thereto so that the first and second sheets also automatically deform into a cylindrical configuration; and heat sink wires positioned transversely with respect to the memory wires between the first and second sheets for retaining heat applied to the hair roller. When heat is removed from the formed memory wires, they retain their circular configuration, but can be manually biased back to their flat configurations. In addition, apparatus for heating the hair rollers includes a positioning device which positions a cylindrically formed hair roller thereabout and a heater associated with the positioning device for heating a hair roller to cause the hair roller to automatically wrap about the positioning device into the cylindrical configuration.

13 Claims, 11 Drawing Sheets

FIG. 4
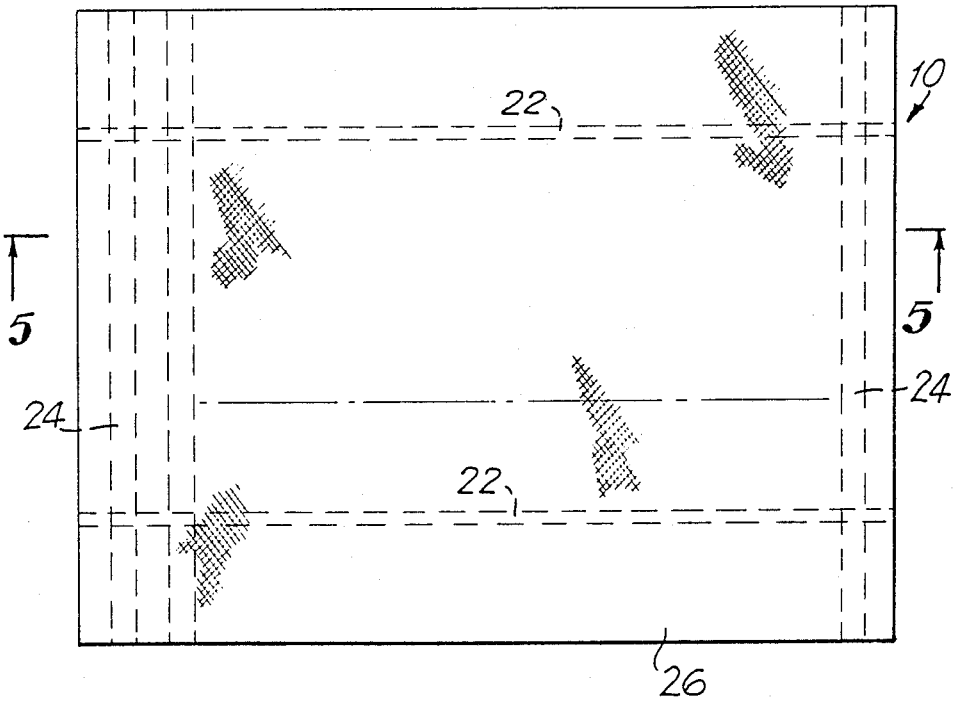
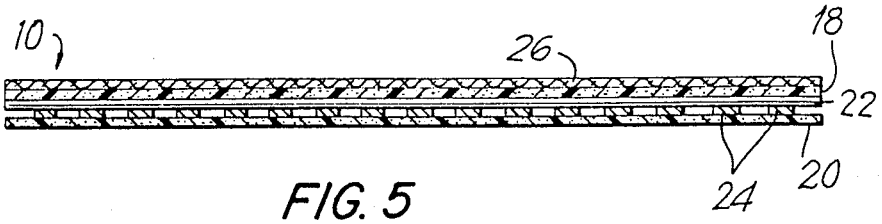
FIG. 5

FIG. 19
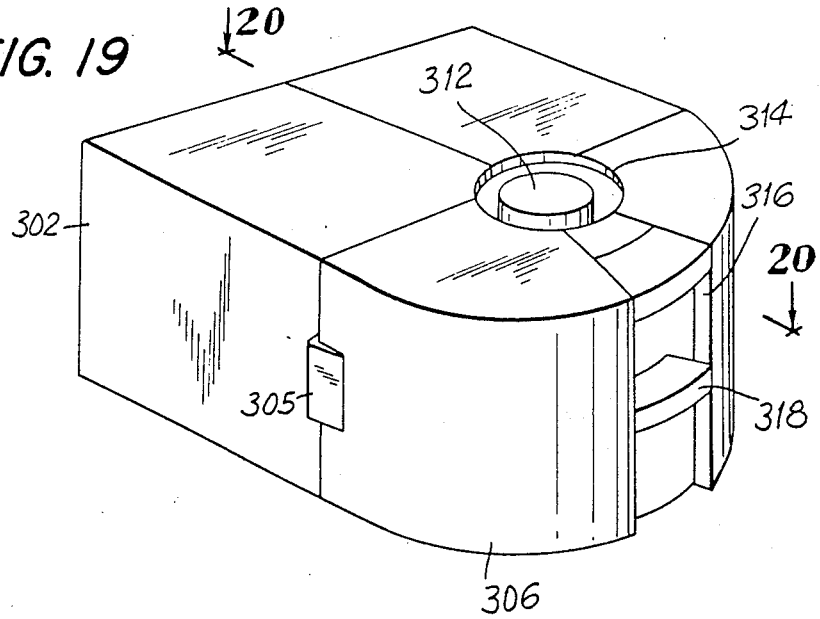
FIG. 20
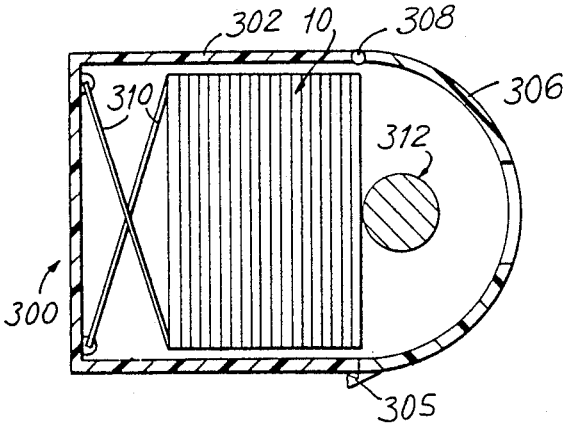
FIG. 21
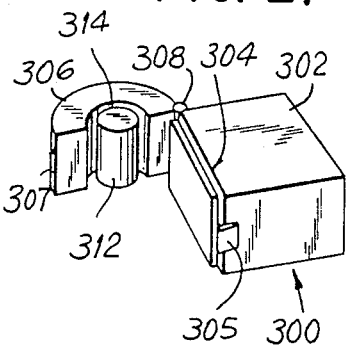
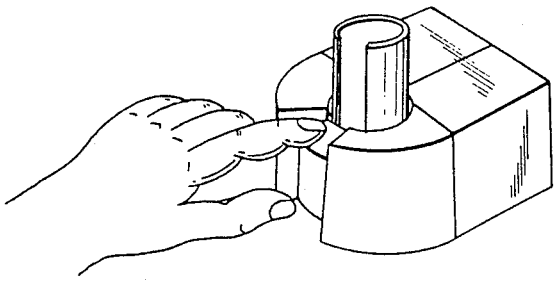
FIG. 22

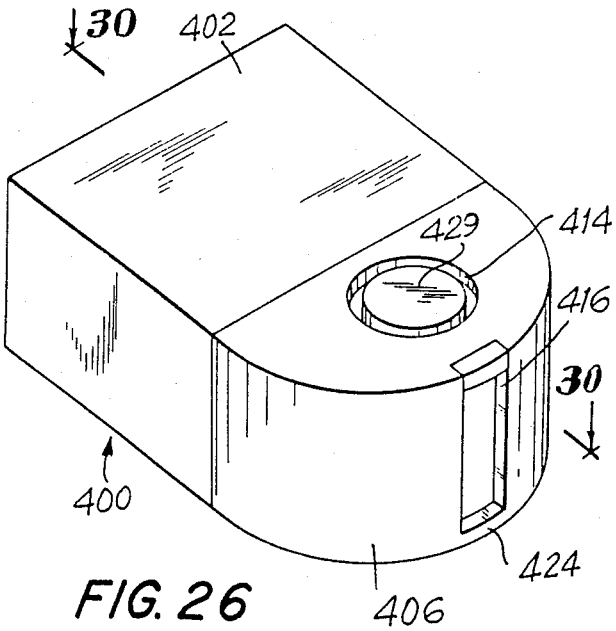
FIG. 26
FIG. 27
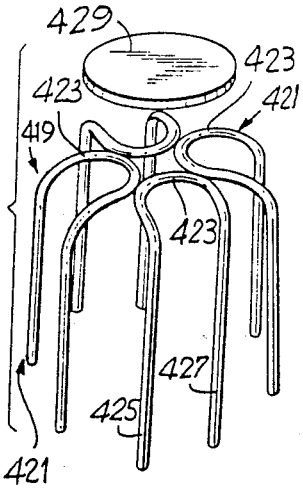
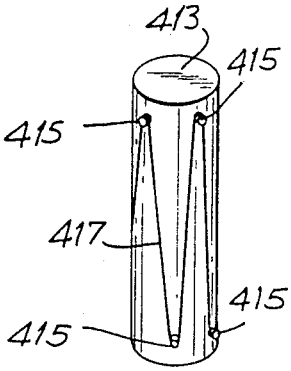
FIG. 28
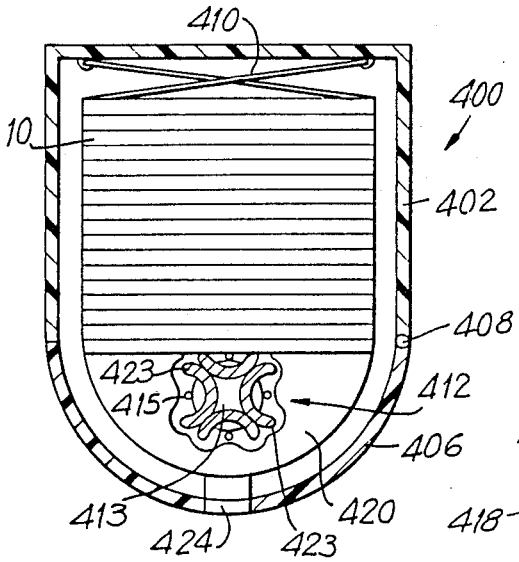
FIG. 30
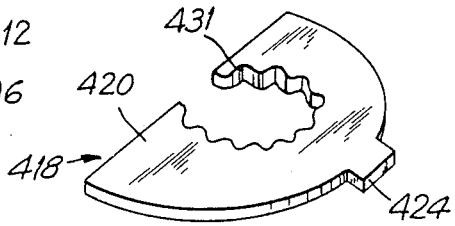
FIG. 29

CONVERTIBLE HAIR ROLLER

BACKGROUND OF THE INVENTION

This invention relates generally to hair curling devices and, more particularly, is directed to a convertible hair curler.

Cylindrically shaped hair curlers or rollers for curling and styling hair are well-known. Generally, tresses of hair are rolled about the cylindrically shaped hair rollers in order to achieve a desired appearance when the rollers are removed. In order to expedite the hair rolling process, heated hair rollers of the aforementioned type have been used. For example, it is well-known to store pre-formed cylindrical hair rollers in a container which also includes heating elements therein for heating up the rollers. In such case the heating elements transfer heat to the rollers which store the heat. Examples of such devices can be found in U.S. Pat. No. 4,584,462 and are also sold by Conair Corporation, 11 Executive Avenue, Edison N.J. 08817 under the trademark "Hot Sticks".

However, because of the combined volume of the pre-formed hair rollers, the heater elements and the container, the entire product becomes extremely bulky. As a result, such product occupies a great amount of bathroom or other counter space and is extremely inconvenient for traveling.

A hair roller is also known from U.S. Pat. No. 3,285,795 to Stein which discloses a hair roller formed of two semi-cylindrical arcuate strips that are heat sealed together at their opposing longitudinal edges. The inside surface is coated with a heat generating chemical. When a hair tress has been wrapped around the roller, it is moistened and such moistening causes the heat generating chemical to generate heat sufficient to cause expansion of the roller which causes tightening of the wrapped tress thereabout. Such Patent also discloses Christmas balls formed by two circular flat sheets having their edges sealed together. When subjected to heat, the flat sheets expand to form a spherical Christmas ball. However, once the Christmas ball is expanded, it cannot be re-flattened.

Another hair roller is described in U.S. Pat. No. 4,141,370 to Haas. However, this hair roller is a conventional hair roller and is pre-formed in the cylindrical configuration and maintained in such configuration. A hair curling apparatus is disclosed in U.S. Pat. No. 4,267,430 to Downey.

OBJECTS AND SUMMARY OF THE INVENTION

Accordingly, it is an object of the present invention to provide a hair roller that avoids the aforementioned disadvantages encountered with the prior art.

More particularly, it is an object of the present invention to provide a hair roller which requires minimum volume for storage and heating.

It is another object of the present invention to provide a hair roller which is stored and heated in a substantially flat configuration which automatically converts to a cylindrical configuration on the application of heat thereto.

It is yet another object of the present invention to provide a hair roller that can repeatedly be converted between a flat configuration and a cylindrical configuration.

It is a further object of the present invention to provide a hair roller that is easy and economical to manufacture and use.

It is a still further object of the present invention to provide a heating device for heating the aforementioned hair rollers.

It is yet a further object of the present invention to provide a heating device for heating the aforementioned hair rollers that is easy and economical to use, while being extremely compact in size.

In accordance with an aspect of the present invention, a convertible hair roller includes a deformable layer of material capable of repeated deformation between a flat configuration and a cylindrical configuration, the layer including maintaining means for maintaining the sheet in the cylindrical configuration.

In accordance with another aspect of the present invention, a convertible hair roller includes a first sheet; a second sheet in parallel spaced relation from the first sheet; at least one memory wire positioned between said first and second sheets; each memory wire capable of repeated deformation between a straight configuration and a circular configuration, each memory wire automatically deforming from the flat configuration to said circular configuration upon the application of heat at least equal to a predetermined temperature thereto, whereby the first and second sheets automatically deform into a cylindrical configuration and are maintained in the cylindrical configuration after the heat has been removed; and heat retaining means positioned between the first and second sheets for retaining the heat applied to said hair roller.

In accordance with still another aspect of the present invention, apparatus for heating a convertible hair roller of the type including a deformable layer of material capable of repeated deformation between a flat configuration and a cylindrical configuration with such hair roller including maintaining means for maintaining the layer in the cylindrical configuration, includes central positioning means for positioning the hair roller thereabout when the hair roller is deformed into the cylindrical configuration; and heater means associated with the central positioning means for heating the hair roller to cause the hair roller to automatically wrap about the central positioning means into the cylindrical configuration.

The above and other objects, features and advantages of the present invention will become readily apparent from the following detailed description thereof which is to be read in connection with the accompanying drawings.

BRIEF DESCRIPTION OF THE DRAWINGS

FIG. 4 is a top plan view, partially in phantom, of the hair roller of FIG. 1;

FIG. 5 is a cross-sectional view of the hair roller of FIG. 4, taken along line 5—5 thereof;

FIG. 19 is a perspective view of a hair roller heating device according to another embodiment of the present invention, in a closed position;

FIG. 20 is a cross-sectional view of the hair roller heating device of FIG. 19, taken along line 20—20 thereof;

FIG. 21 is a perspective view of the hair roller heating device of FIG. 19, in its open position;

FIG. 22 is a perspective view of the hair roller heating device of FIG. 19, with a hair roller heating and popped out therefrom;

FIG. 26 is a perspective view of a hair roller heating device according to another embodiment of the present invention;

FIG. 27 is a perspective view of a cylindrical cage used in the hair roller heating device of FIG. 26;

FIG. 28 is a perspective view of the radiant heater of the hair roller heating device of FIG. 26;

FIG. 29 is a perspective view of the ejection lever of the hair roller heating device of FIG. 26; and FIG. 30 is a cross-sectional view of the hair roller heating device of FIG. 26, taken along line 30—30 thereof.

DETAILED DESCRIPTION OF THE PREFERRED EMBODIMENTS

Figure 1:
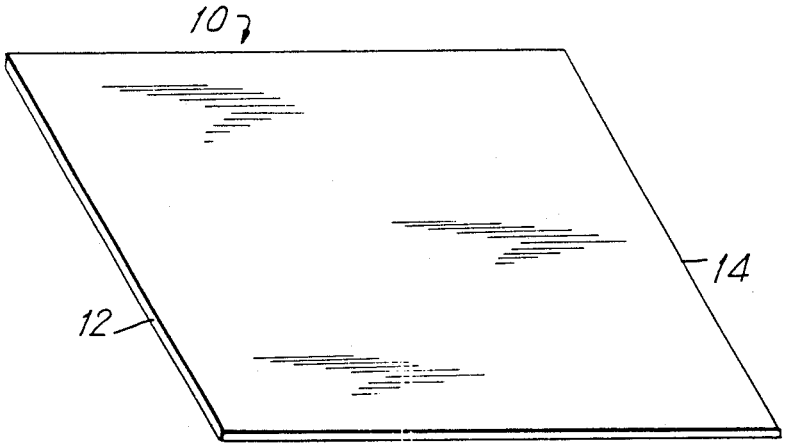
FIG. 1 is a perspective view of a hair roller according to one embodiment of the present invention in a flat configuration.
Figure 2:
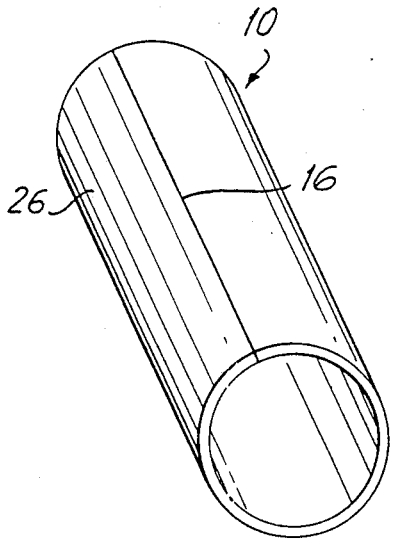
FIG. 2 is a perspective view of the hair roller of FIG. 1 in a cylindrical configuration.

Referring to the drawings in detail, and initially to FIGS. 1-5 thereof, a hair roller 10 according to one embodiment of the present invention is initially in a substantially flat rectangular configuration, as shown in FIGS. 1 and 4. However, upon the application of heat to a predetermined temperature, hair roller 10 automatically deforms into the cylindrical configuration shown in FIG. 2, with opposite edges 12 and 14 thereof abutting and meeting at a common joining line 16. In the cylindrical condition shown in FIG. 2, opposite edges 12 and 14, although abutting, remain unsecured to each other. When heat is removed from hair roller 10 so that the latter cools below a predetermined temperature, hair roller 10 can be manually flattened to the configuration shown in FIG. 1 for easy and compact storage.

Figure 3:
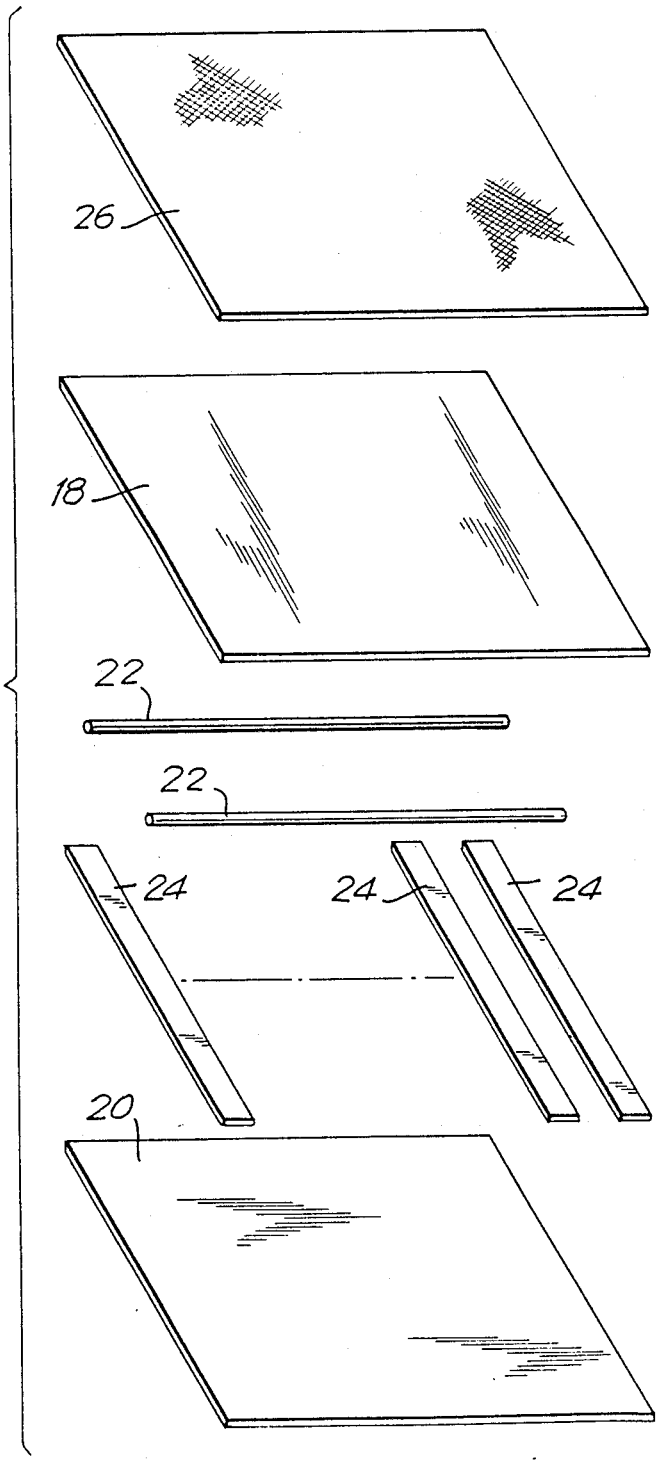
FIG. 3 is a blown apart view of the hair roller of FIG. 1.

As shown in FIG. 3, hair roller 10 is preferably formed from a plurality of layers of different materials. Specifically, in a preferred embodiment, first and second sheets 18 and 20 are provided in parallel, spaced relation, and the outer edges thereof may be secured to each other. Preferably, first and second sheets 18 and 20 are made from a flexible material such as room temperature vulcanizing (RTV) silicon and have dimensions, for example, of 8 cm×6 cm.

In order to provide the automatic deformation of hair roller 10 into the cylindrical configuration upon the application of heat, at least one shaped memory wire 22 is sandwiched between first and second sheets 18 and 20. Preferably, two such shaped memory wires 22 are sandwiched between first and second sheets 18 and 20 in parallel spaced relation. When subjected to heat at a predetermined temperature, each memory wire 22 will curl automatically into a circular configuration, and thereby curl first and second sheets 18 and 20 therewith. It is in this manner that automatic formation of hair roller 10 occurs upon the application of heat. As long as heat of a predetermined temperature is applied to memory wires 22, they will be maintained in their circular configuration and cannot be flattened out. Upon the removal of the heat from the memory wires 22, the memory wires 22 will retain the circular configuration, although they can be manually deformed back to the straight configuration shown in FIG. 3. Thereupon, if heat is again applied to memory wires 22, they will again deform to their circular configurations. Preferably, memory wires 22 are alloy wires formed, for example, from Nitinol sold by Raychem Company of Menlo Park, Calif.

When memory wires 22 are converted to their circular or loop configurations, heat is no longer necessary to maintain memory wires 22 in such configuration and it is generally removed. In such case, in order for hair roller 10 to retain its heat for the curling operation, heat sink wires 24 are also sandwiched between first and second sheets 18 and 20 and, in particular, between memory wires 22 and a second sheet 20 and extend transversely to and in contact with shaped memory wires 22. In a preferred embodiment, approximately twenty-three such heat sink wires 24 are provided. Heat sink wires 24 can be made of any conventional metal material which will retain heat for an extended period of time upon the removal of heat therefrom in order that hair roller 10 will remain heated for the hair curling operation.

In addition, an outer textured layer or coating 26 is provided on the external surface of first sheet 18 to impart a desirable feel to the outer surface of hair curler 10 when it is converted to the cylindrical configuration. Outer textured layer 26 may be any suitable material, such as velveteen or flocking. It is this outer textured layer 26 that comes into contact with the hair tresses.

Thus, with this arrangement, a plurality of hair rollers 10 can be stored in a stacked, flat relationship and can be easily converted to cylindrical hair rollers upon the application of heat thereto. After the hair curling operation has been completed, the hair rollers cool down and can then manually be converted back to their flat configurations.

Figure 6:
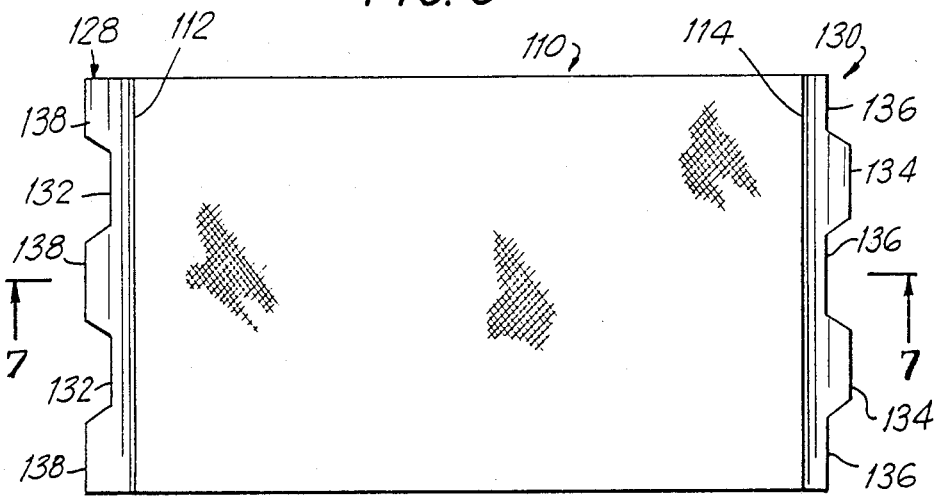
FIG. 6 is a top plan view of a hair roller according to another embodiment of the present invention.
Figure 7:
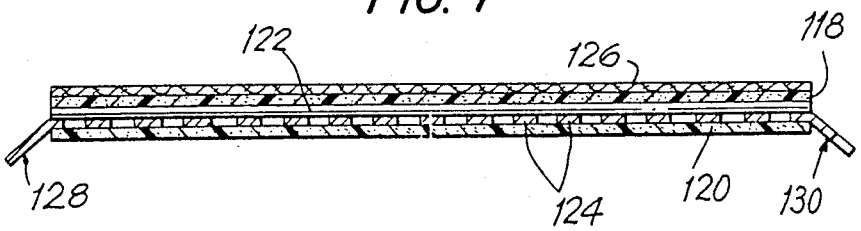
FIG. 7 is a cross-sectional view of the hair roller of FIG. 6, taken along line 7—7 thereof.

Referring now to FIGS. 6 and 7, a modified hair roller 110 according to another embodiment of the present invention will now be described, in which elements corresponding to those described above with respect to the embodiment of FIGS. 1–5 are identified by the same reference numeals, augmented by 100, and a detailed description thereof will be omitted herein for the sake of brevity. As shown, hair roller 110 is identical to hair roller 10 with the exception that opposite edges 112 and 114 of hair roller 110 are provided with and locking elements 128 and 130, respectively, with end locking element 128 having recesses 132, which are complimentary to raised sections 134 of end locking element 130. In like manner, end locking element 130 has recesses 136 which are complimentary to raised sections 138 of end locking element 128. In this manner, when hair roller 110 is converted to its cylindrical configuration, end locking elements 128 and 130 engage each other such that recesses 132 engage raised sections 134 and recesses 136 engage raised sections 138. This provides that opposite edges 112 and 114 of hair roller 110 will not wrap past the desired cylindrical configuration. As shown in FIG. 7, end locking elements 128 and 130 extend from opposite edges 112 and 114 of the layer containing heat sink wires 124 and extend downwardly at a slight angle to prevent hair roller 110 from wrapping about itself.

Figure 8:
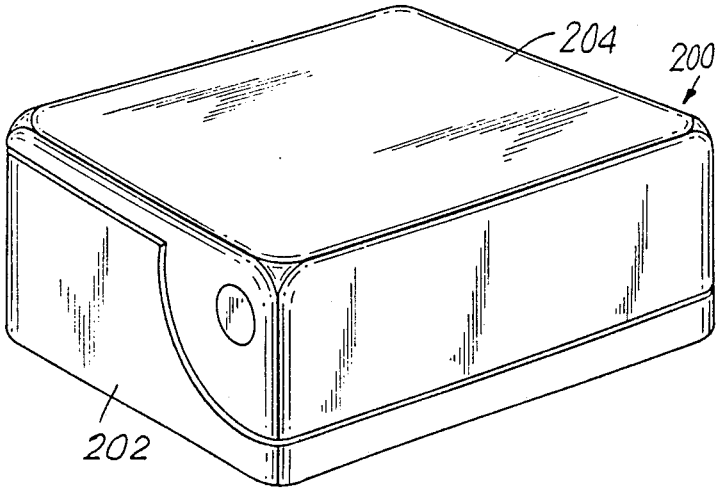
FIG. 8 is a perspective view of a hair roller heating device according to one embodiment of the present invention, in a closed position for heating the hair rollers of FIGS. 1-7.
Figure 10:
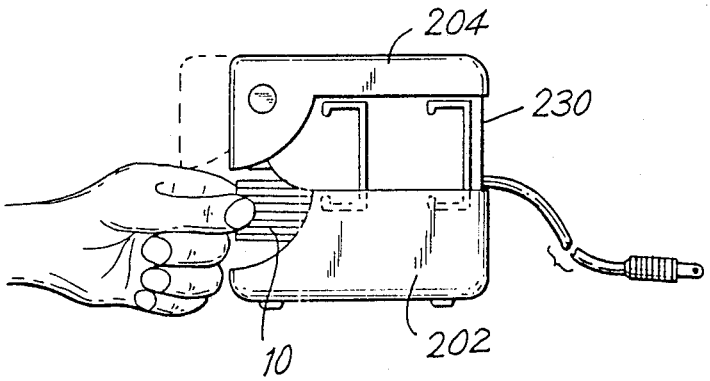
FIG. 10 is a side elevational view of the hair roller heating device of FIG. 8 in its open position.
Figure 9:
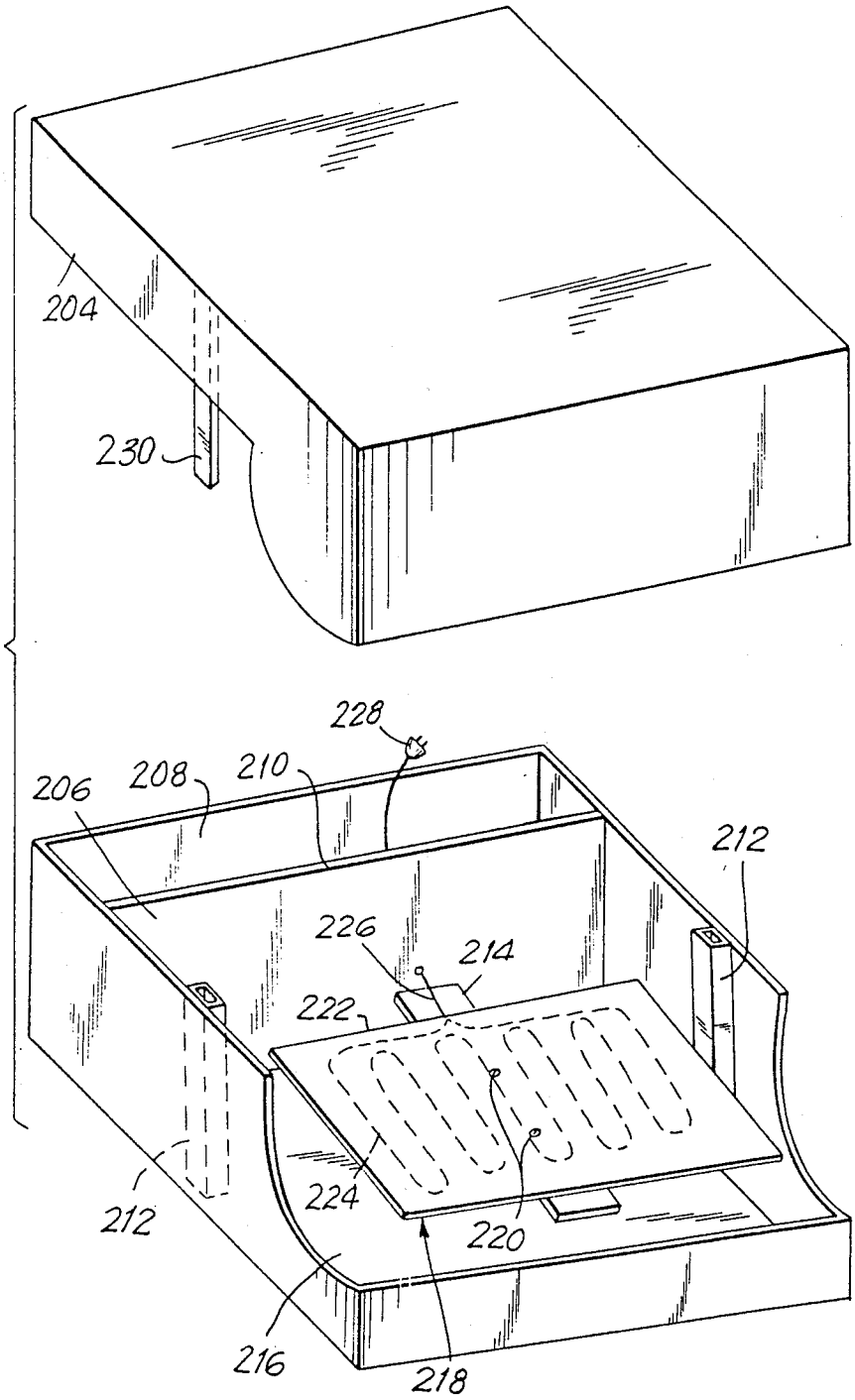
FIG. 9 is a blown apart view of the hair roller heating device of FIG. 8.

Referring now to FIGS. 8–10, a hair roller heating device 200 according to one embodiment of the present invention, generally includes a base 202 and a cover 204 movable between the closed position of FIG. 8 and the opened position of FIG. 10. Base 202 is generally hollow and includes a main chamber 206 and a rear chamber 208 separated from main chamber 206 by a rear partition wall 210. In addition, outer telescoping supports 212 are provided on opposite sides of base 202 within main chamber 206.

In accordance with the present invention, a cantilevered support bar 214 extends forwardly from rear partition wall 210 in a horizontal manner within main chamber 206 and in vertically spaced relation from the floor 216 which defines main chamber 206. In a first embodiment of the present invention, a heating member 218 is centrally secured on support bar 214, by screws 220 or the like. Heating member 218 is preferably comprised of a thin plastic sheet 222 having an electrical wire 224 embedded therein in a tortuous or zig-zag manner, wire 224 being connected to a connection wire 226 that extends through rear partition wall 210 and has an electrical plug 228 secured at the opposite end for plugging within a conventional wall socket so as to power apparatus 210 and thereby heat up heating member 218. For example, sheet 222 can be made of a mylar-type flexible material such as that sold by Electrofilm in California under the trademark "Kapton". Electrical wire 224 can be photo-etched on sheet 222.

Rear chamber 208 is therefore used to contain plug 228 and connection wire 226, in addition to additional hair rollers 10, 110.

Cover 204 is provided with two inner telescoping posts 230 at opposite sides thereof which fit within outer telescoping supports 212, whereby cover 204 can be raised up, as shown in FIG. 10, with respect to base 202 so as to expose heating member 218.

Figure 11:
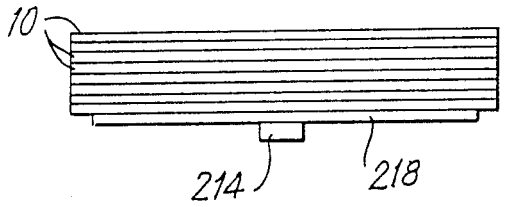
FIG. 11 is a front elevational view of a portion of the hair roller heating device of FIG. 10 with the lowermost hair roller being in an unheated state.
Figure 12:
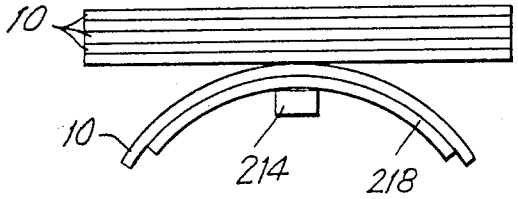
FIG. 12 is a front elevational view of the portion of the hair roller heating device of FIG. 11 with the lowermost hair roller being partially deformed by application of heat thereto.
Figure 13:
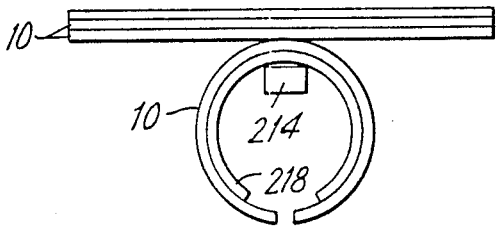
FIG. 13 is a front elevational view of the portion of the hair roller heating device of FIG. 11 with the lowermost hair roller being deformed into the cylindrical configuration by application of heat thereto.

In operation, and with reference to FIGS. 11–12, a plurality of hair rollers 10 are mounted on top of heating member 218 which has dimensions similar to hair rollers 10. In this regard, hair rollers 10 are in their flat configuration since no heat has been applied thereto. Therefore, electrical current is supplied through plug 228 and wires 226 and 224 to heat up heating member 218. As a result, heat is transferred to the lowermost hair roller 10 on the stack, which begins to heat up. Accordingly, memory wires 22 of the lowermost hair roller 10 begin to deform into a circular configuration, as shown in FIG. 12. Upon the application of still further heat, memory wires 22 thereof deform into a completely circular configuration, as shown in FIG. 13. During the deformation of hair roller 10 into the cylindrical configuration shown in FIG. 13, it will be appreciated that heating member 218 is also rolled into the cylindrical configuration within hair roller 10. Then, as shown in FIG. 10, the user removes cylindrical hair roller 10 from hair roller heating device 200 and wraps the tresses of hair thereabout. Because of heat sink wires 24, hair roller 10 retains the heat therein and because of shaped memory wires 22, hair roller 10 is maintained in the cylindrical configuration.

During the above procedure, insufficient heat is supplied to hair rollers 10 above the lowermost hair roller 10 of the stack. Accordingly, the remaining hair rollers 10 are not deformed. After the lowermost hair roller 10 has deformed into its cylindrical configuration and been removed, heating member 218 springs back to the position shown in FIG. 11 so as to heat the next lowermost hair curler 10, and so on until the desired number of hair rollers 10 have been heated and removed.

After the hair curling operation has been completed, the hair rollers 10 are removed from the person's hair. At such time, even though the heat has been removed therefrom, memory wires 22 retain such hair curlers 10 in their cylindrical configurations. However, because the hair rollers 10 are now cool, they can be manually bent back, rather easily, to the flat configuration shown in FIG. 1.

Figure 14:
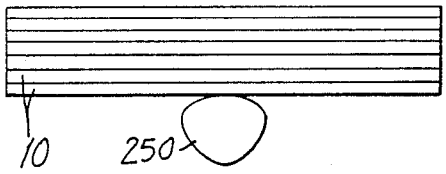
FIG. 14 is a front elevational view of a modified portion of the hair roller heating device of FIG. 11 with the lowermost hair roller in an unheated state.
Figure 15:
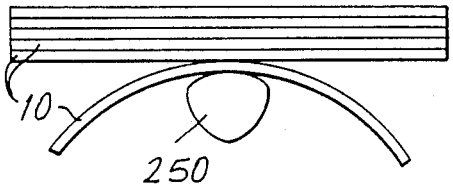
FIG. 15 is a front elevational view of the portion of the hair roller heating device of FIG. 14 with the lowermost hair roller being in a partially deformed by the application of heat thereto.
Figure 16:
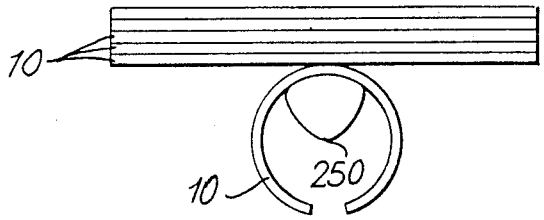
FIG. 16 is a front elevational view of the portion of a the hair roller heating device of FIG. 14 with the lowermost hair roller being deformed into the cylindrical configuration by application of heat thereto.

In accordance with an alternative embodiment of the present invention, cantilevered support bar 214 and heating member 218 are replaced by a cantilevered heating member 250 having a substantially triangular configuration with very rounded edges. In such case, cantilevered heating member 250 can be made of a heat generating material upon the application of current thereto or may have electrical wires embedded therein for applying heat thereto. In such case, the lowermost hair roller 10 rests directly on cantilevered heating member 250 and is heated directly thereby, in the same manner as discussed with respect to heating member 218. Therefore, upon the application of heat, the lowermost hair roller 10 rolls and wraps about cantilevered heating member 250, as shown in FIGS. 14–16, whereupon it can be removed therefrom, in the same manner shown in FIG. 10.

Thus, with the present invention, because hair rollers 10 can be stacked flat on top of each other and heated one at a time, a minimum amount of space is required in hair roller heating device 200 so that the latter can be made in a compact manner, generally the size of a small cassette tape player.

Figure 17:
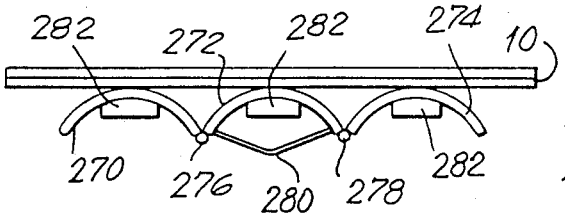
FIG. 17 is a front elevational view of a modified heating bar according to the present invention for use with the hair roller heating device of FIG. 8.
Figure 18:
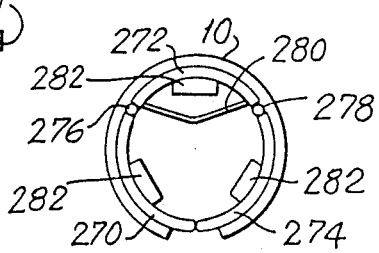
FIG. 18 is a front elevatinal view of the heating bar of FIG. 17 in a closed position.

An alternative embodiment for the heating member is shown in FIGS. 17 and 18. As shown therein, three arcuate heating members 270, 272 and 274 are provided, each subtending an angle of approximately 60 degrees, with arcuate heating members 270 and 274 being hingedly connected at edges thereof to opposite edges of arcuate heating member 272 by hinge members 276 and 278, respectively. Arcuate heating member 272 is fixedly mounted to rear partition wall 210 in much the same manner as heating bar 214. A spring 280 is connected to arcuate heating member 272 for normally urging heating members 270, 272 and 274 to the open position shown in FIG. 17. In addition, a resistive heating device 282, such as a perpetual thermocouple (PTC) heater, is fixed to the concave underside of each arcuate heating member 270, 272 and 274 for heating the same. In this regard, arcuate heating members 270, 272 and 274 can be made of a sheet metal material.

As shown, with the lowermost hair roller 10 resting on arcuate heating members 270, 272 and 274, as shown in FIG. 17, heat is applied thereto by means of PTC heaters 282. Accordingly, the lowermost hair roller 10 is heated and begins to deform into its cylindrical configuration. During this deformation, hair roller 10 biased arcuate heating members 270 and 274 about hinges 276 and 278, against the force of spring 280, to the position shown in FIG. 18. It will be appreciated that because hair roller 10 is always in contact with arcuate heating members 270 and 272 during the deformation process, more heat is supplied to the hair rollers so that hair roller 10 assumes its cylindrical configuration in a shorter time period. After the deformed hair roller is removed from the hair roller heating device, in the same manner as shown in FIG. 10, spring 280 biases arcuate heating sections 270 and 274 to the position shown in FIG. 17 to heat the next lowermost hair roller.

Referring now to FIGS. 19–22, a hair roller heating device 300 according to another embodiment of the present invention, generally includes a hollow main body 302 having an open front end 304, and a cover 306 hingedly connected to main body 302 in covering relation to open front end 304, by a conventional hinge assembly 308. A latch 305 can be provided at open front end 304 at the side opposite to hinge assembly 308 for releasably engaging a catch 307 on cover 306 when the latter is closed. Main body 302 is intended to hold a plurality of vertically oriented hair rollers 10 in side by side stacked relation, as shown in FIG. 20. In order to bias the stacked hair rollers 10 toward open front end 304, a torsion spring 310 is provided at the rear of main body 302 to apply such a force to hair rollers 10.

A heating member in the form of a vertically oriented, cylindrical heating post 312 is provided in cover 306, and a hole 314 is provided in the upper surface of cover 306 in surrounding relation to heating post 312, hole having a diameter greater than that of heating post 312. Cover 306 also includes an opening 316 along its front wall, through which a lever 318 is exposed for ejecting a heating hair roller 10 in cylindrical form, from hair roller heating device 300.

In general operation, the stack of hair rollers 10 is biased against heating post 312 by torsion spring 310. The hair roller 10 in contact with heating post 312 is heated thereby, and accordingly, deforms into the aforementioned cylindrical shape about heating post 312. Then, lever 318 is activated to eject the cylindrical hair roller 10 upwardly through hole 314, as shown in FIG. 22, whereby the user grasps the cylindrical hair roller 10 and pulls it completely out. At such time, torsion spring 310 pushes the next forward-most hair roller 10 in the stack against heating post 312, and this hair roller 10 is heated into its cylindrical configuration, and so on.

Figure 23:
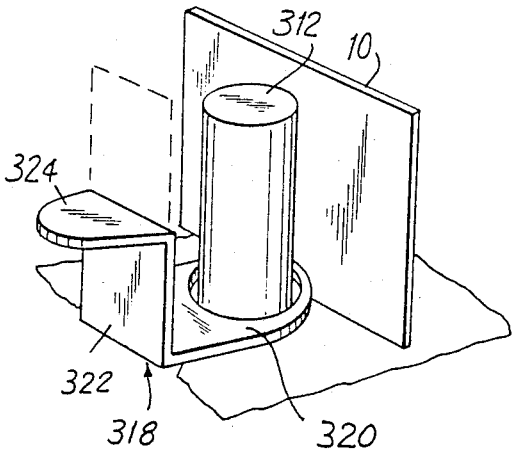
FIG. 23 is a perspective view of an ejection lever that can be used with the hair roller heating device of FIG. 19.
Figure 24:
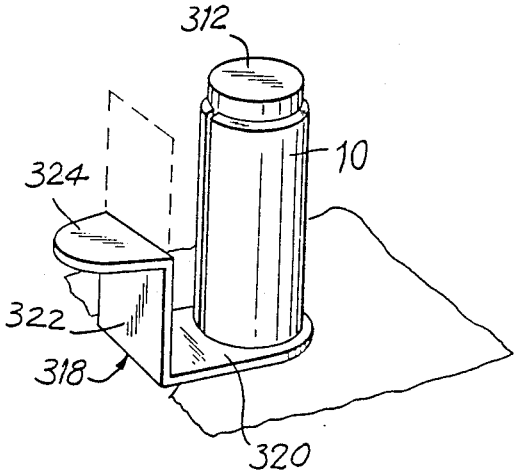
FIG. 24 is a perspective view of the ejection lever of FIG. 23, when the hair roller deforms about the heating post.
Figure 25:
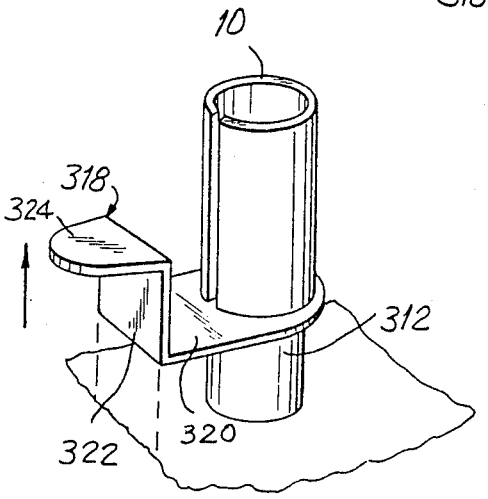
FIG. 25 is a perspective view of the ejection lever of FIG. 23, shown ejecting a cylindrical hair roller from the hair roller heating device of FIG. 19.

As an example of an ejection lever 318 that can be used, reference is now made to FIGS. 23–25. As shown therein, ejection lever 318 can have a generally L-shaped form, with one leg 320 being horizontally positioned about heating post 312. Specifically, leg 320 includes an aperture 322 so that leg 320 is always positioned in sliding relation about heating post 312. The other leg 322 is vertically oriented in adjacent opening 316 and within cover 306, and is connected to the front edge of leg 320. A tab 324 extends forwardly from the upper edge of leg 322 for engagement by the user, and extends out from opening 316 is cover 306.

Normally, as shown in FIG. 23, leg 320 sits upon the bottom wall of cover 306 in surrounding relation to heating post 312. When a hair roller 10 is heated and deforms about heating post 312, the cylindrically formed hair roller 10 rests on leg 320, as shown in FIG. 24. Accordingly, when the user biases tab 324 upwardly, as shown in FIG. 25, lever 318 moves upwardly and the cylindrically formed hair roller 10 is biased upwardly out from hole 314 in the upper surface of cover 306 to be grasped by the user (FIG. 22).

Referring now to FIGS. 26–30, there is shown another embodiment of a hair roller heating device 400 according to the present invention, in which elements corresponding to those in the embodiment of FIGS. 19–22 are identified by the same reference numerals augmented by 100, and a detailed description thereof will be omitted herein for the sake of brevity.

Specifically, a radiant heater 412 is provided in place of heating post 312. Radiant heater 412 includes a central post 413, preferably made of ceramic, and having a plurality of pins 415 secured circumferentially thereto adjacent the upper and lower ends thereof. A heating wire 417, such as a Nichrome wire, is wrapped about pins 415 in a zig-zag manner, alternating between an upper pin and a lower pin, as shown in FIG. 28. Central post 413 is arranged in the same manner as heating post 312 shown in FIG. 20.

A metallic cage 419, as shown in FIG. 27, surrounds post 413. Cage 419 is preferably formed from four metal wire elements 421, each element 421 having a U-shaped upper portion 423 arranged substantially parallel to the ground, and two supporting legs 425 and 427 secured to the free ends of U-shaped upper portion 423 and extending vertically downward thereof in supporting contact with the bottom of cover 406. U-shaped upper portions 423 are exposed through hole 414 in cover 406, and accordingly, an insulating cap 429 is secured on U-shaped upper portions 423 in covering relation to U-shaped upper portions 423 through hole 414 so as to protect the user.

Thus, when current is supplied to heating wire 417, the latter heats up and, in turn, heats air roller 10 by radiant heat. As a result, the forwardmost hair roller 10 in contact with cage 419 continues to be heated by radiant heat and is caused to deform thereabout.

In order to eject the cylindrically deformed hair roller 10, an ejection lever 418 is provided in cover 406. Specifically, ejection lever 418 includes a base 420 that is always positioned in sliding relation about cage 419, as shown in FIG. 30. In this regard, base 420 is a suitably cut-out, as at 431, to slide about cage 419. In addition, a tab 424 is provided at the forward end of base 420 and extends out of opening 416 for grasping by the user. Thus, when a hair roller 10 is deformed about cage 419, it sits upon base 420. Thereafter, the user grasps tab 424, and moves base 420 upwardly about cage 419. As a result, the cylindrically deformed hair roller is ejected out of cover 406 through hole 414, to be grasped by the user.

Of course, other modifications can be made to the present invention within the scope of the claims. For example, a bimetal strip can be used in place of the memory wires of the hair roller.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined in the appended claims.

What is claimed is:

1. A hair styling device comprising:

(a) a deformable sheet of material capable of repeated transformation from a first, storage condition, being substantially flat to a second, hair styling use condition, in a substantially cylindrical shape, and said sheet contains means for transforming the sheet from said storage condition to said condition by the selected application of heat above a predetermined minimum temperature;

(b) said sheet of material having maintaining means associated therewith for holding said device in said use condition even after removal of said heat at said predetermined minimum temperature until said sheet is mechanically transformed back to said storage condition.

2. A hair styling device as claimed in claim 1, wherein said sheet of material has a portion thereof manufactured from Nitinol.

3. A hair styling device as claimed in claim 1, wherein said sheet of material further comprises a heat retaining means for maintaining, for some time, the heat of said hair styling device, even after the removal of said heat required to transform said sheet of material from said storage condition to said hair styling use condition.

4. A hair styling device as claimed in claim 3, wherein said heat retaining means are a plurality of metallic wires.

5. A hair styling device as claimed in claim 1, wherein: the exterior circumferential surface of said cylindrical shape is provided with tactile means for imparting a desirable feel to said device.

6. A hair styling device as claimed in claim 5, wherein said tactile means is velveteen.

7. A hair styling device as claimed in claim 5 wherein said textile means is flocking.

8. A hair styling device as claimed in claim 1 for further comprising edge mating means for said sheet of material which prevents said device from rolling on itself during said transformation from said storage condition to said hair styling condition.

9. A hair styling device as claimed in claim 1, wherein said edge mating means comprises opposed sets of interengaging raised sections and recesses.

10. A hair styling device as claimed in claim 1, wherein said sheet of material comprises room temperature vulcanizing silicon.

11. A hair styling device as claimed in claim 1 wherein said sheet of materal comprises a sandwich-like construction of flexible RTV silicon sheets having at least one heat sensitive memory means housed between said silicon sheets.

12. A hair styling device as claimed in claim 11 further including a plurality of heat retaining wires also sandwiched between said silicon sheets.

13. A hair styling device as claimed in claim 12 wherein said heat retaining wires are angularly oriented with respect to said heat sensitive memory means.

* * * * *